US006167856B1

(12) United States Patent
Rao et al.

(10) Patent No.: US 6,167,856 B1
(45) Date of Patent: Jan. 2, 2001

(54) LOW FRICTION CAM SHAFT

(75) Inventors: Vemulapalli Durga N. Rao, Bloomfield Township; Harry Arthur Cikanek, Northville; Daniel Joseph German, Belleville; Daniel Michael Kabat, Oxford, all of MI (US)

(73) Assignee: Ford Global Technologies, Inc., Dearborn, MI (US)

( * ) Notice: Under 35 U.S.C. 154(b), the term of this patent shall be extended for 0 days.

(21) Appl. No.: 08/115,974

(22) Filed: Sep. 3, 1993

Related U.S. Application Data

(63) Continuation-in-part of application No. 07/975,320, filed on Nov. 12, 1992, now abandoned.

(51) Int. Cl.[7] ..... F01L 1/16

(52) U.S. Cl. ..... 123/90.51; 123/90.6; 123/90.33; 123/188.9; 74/569

(58) Field of Search ..... 123/90.27, 90.33, 123/90.48, 90.51, 90.6, 188.3, 188.5, 188.9; 74/569, 567

(56) References Cited

U.S. PATENT DOCUMENTS

| | | | | |
|---|---|---|---|---|
| Re. 33,888 | * | 4/1992 | Hartnett et al. | 29/888.1 |
| Re. 34,143 | | 12/1992 | Rao et al. | 123/193.4 |
| 3,303,833 | | 2/1967 | Melling | 123/90.48 |
| 3,958,541 | * | 5/1976 | Lachnit | 123/90.34 |
| 4,153,017 | | 5/1979 | Behnke | 123/90.51 |
| 4,312,900 | | 1/1982 | Simpson | 427/181 |
| 4,366,785 | | 1/1983 | Goloff et al. | 123/90.51 |
| 4,367,701 | | 1/1983 | Buente | 123/90.55 |
| 4,430,970 | | 2/1984 | Holtzberg et al. | 123/90.51 |
| 4,558,960 | | 12/1985 | Lehtinen et al. | 384/373 |
| 4,594,973 | | 6/1986 | Allred et al. | 123/90.4 |
| 4,644,912 | * | 2/1987 | Umeha et al. | 123/90.34 |
| 4,777,842 | * | 10/1988 | Yamada | 123/90.34 |
| 4,781,075 | * | 11/1988 | Yamaji et al. | 74/567 |
| 4,796,575 | | 1/1989 | Matsubara et al. | 123/90.44 |
| 4,835,832 | | 6/1989 | Arnold et al. | 29/523 |
| 4,871,266 | | 10/1989 | Oda | 384/42 |
| 4,872,432 | | 10/1989 | Rao et al. | 123/193 CP |
| 4,873,150 | | 10/1989 | Doi et al. | 123/90.39 |
| 4,909,198 | | 3/1990 | Shiraya et al. | 123/90.51 |
| 4,917,953 | | 4/1990 | Hioki et al. | 428/408 |
| 4,922,785 | | 5/1990 | Arnold et al. | 74/567 |
| 4,969,262 | | 11/1990 | Hiroaka et al. | 29/888.1 |

(List continued on next page.)

FOREIGN PATENT DOCUMENTS

| | | | |
|---|---|---|---|
| 3239325 | | 4/1984 | (DE) . |
| 0030780 | | 6/1981 | (EP) . |
| 0067327 | | 12/1982 | (EP) . |
| 0391499 | | 10/1990 | (EP) . |
| 1102066 | | 2/1968 | (GB) . |
| 1152957 | | 5/1969 | (GB) . |
| 1462766 | | 1/1977 | (GB) . |
| 2093554 | | 9/1982 | (GB) . |
| 2242240 | | 9/1991 | (GB) . |
| 2249811 | | 5/1992 | (GB) . |
| 2272029 | | 5/1994 | (GB) . |
| 2273139 | | 6/1994 | (GB) . |
| 58-214609 | | 12/1983 | (JP) . |
| 37217 | * | 2/1984 | (JP) ..... 123/90.6 |
| 15609 | * | 1/1991 | (JP) ..... 123/90.6 |

* cited by examiner

*Primary Examiner*—Weilun Lo
(74) *Attorney, Agent, or Firm*—Lorraine S. Melotik, Esq.; Roger L. May, Esq.

(57) ABSTRACT

A low friction cam shaft for actuating at least one valve of an internal combustion engine includes a shaft member extending longitudinally, at least one cam secured to the shaft member, the cam being made of a plurality of density metal materials and having an outer surface impregnated with a solid film lubricant that has an affinity for oil and promotes rapid formation of a stable oil film to reduce friction therebetween.

19 Claims, 4 Drawing Sheets

U.S. PATENT DOCUMENTS

| | | | |
|---|---|---|---|
| 4,993,282 | 2/1991 | Swars | 74/567 |
| 4,995,281 | 2/1991 | Allor et al. | 74/559 |
| 5,007,165 | 4/1991 | Podhorsky | 29/888.1 |
| 5,029,562 | 7/1991 | Kamo | 123/193 P |
| 5,035,959 | 7/1991 | Ito et al. | 428/627 |
| 5,040,501 | 8/1991 | Lemelson | 123/188 AA |
| 5,041,168 | 8/1991 | Purnell et al. | 148/13.2 |
| 5,052,352 | 10/1991 | Taniguchi et al. | 123/90.39 |
| 5,054,440 | 10/1991 | Kodakawa | 123/90.5 |
| 5,060,607 | 10/1991 | Taniguchi | 123/90.51 |
| 5,063,894 | 11/1991 | Mielke et al. | 123/193 P |
| 5,066,145 | 11/1991 | Sibley et al. | 384/463 |
| 5,067,369 | 11/1991 | Taniguchi | 74/567 |
| 5,101,554 | 4/1992 | Breuer et al. | 29/888.1 |
| 5,197,351 * | 3/1993 | Hishida | 123/90.6 |
| 5,237,967 | 8/1993 | Willermet et al. | 123/90.51 |
| 5,245,888 * | 9/1993 | Tsuzuki et al. | 123/90.6 |

Fig-1
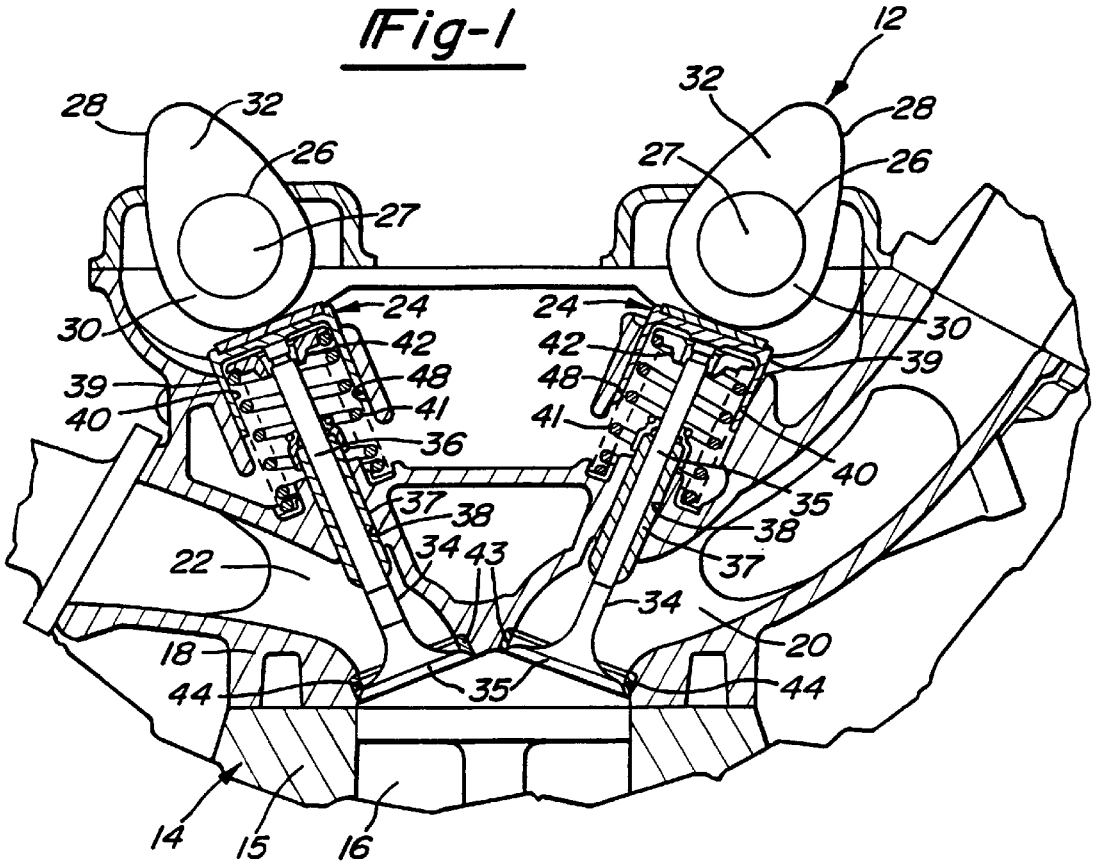
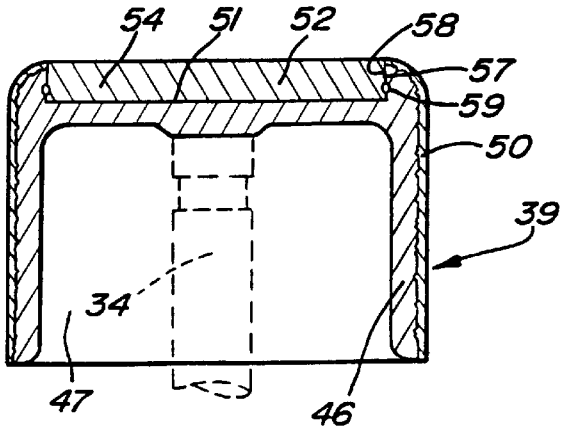
Fig-2

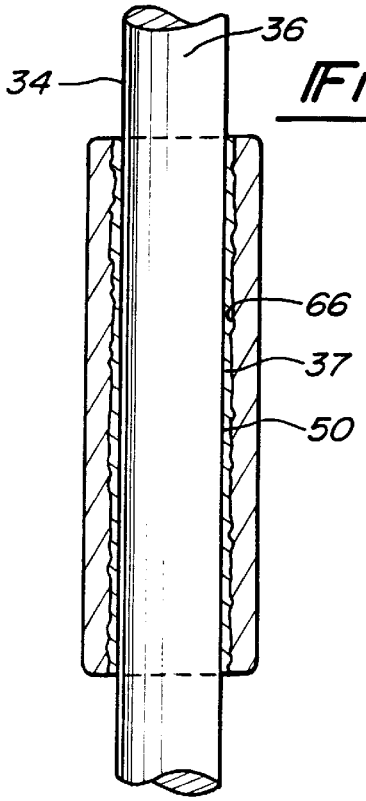
Fig-7
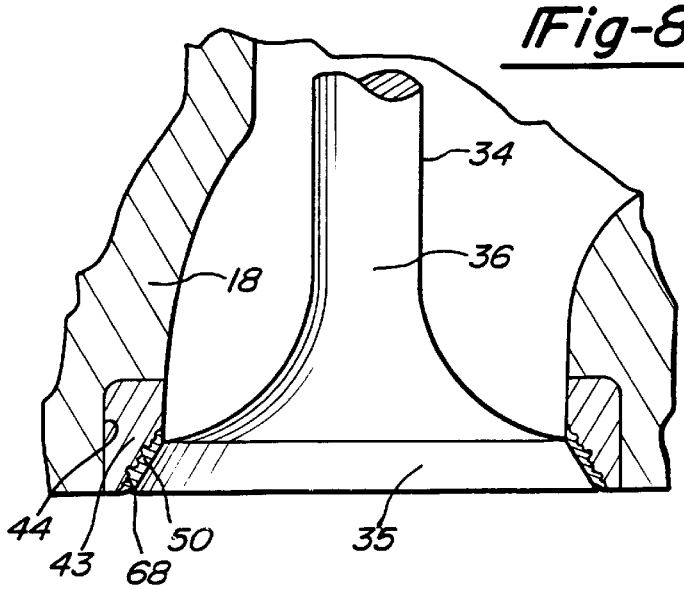
Fig-8
Fig-9
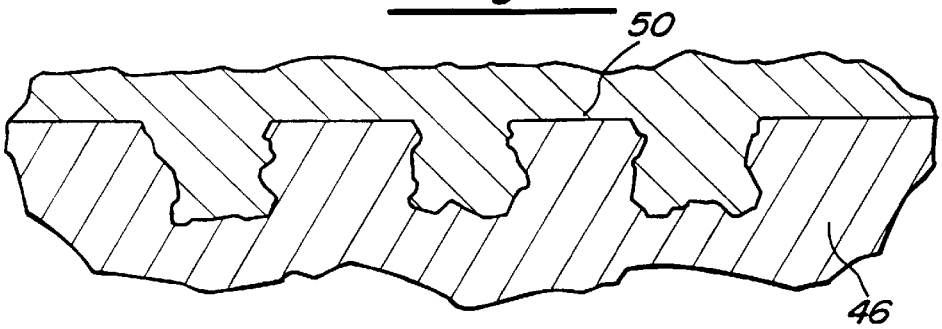
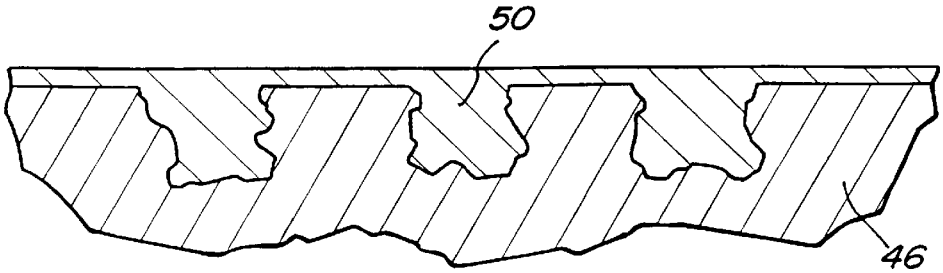
Fig-10

LOW FRICTION CAM SHAFT

CROSS-REFERENCE TO RELATED APPLICATION(S)

The present application is a Continuation-In-Part of Ser. No. 07/975,320, filed Nov. 12, 1992, now abandoned and entitled "Low Friction Valve Train".

BACKGROUND OF THE INVENTION

1. Field of the Invention

The present invention relates generally to internal combustion engines and, more particularly to, a low friction valve train for an internal combustion engine.

2. Description of the Related Art

It is known to construct valve trains for opening and closing valves in engines such as internal combustion engines. Such a valve train may be a direct acting hydraulic bucket tappet valve train for an overhead cam type internal combustion engine. Generally, the valve train includes a tappet which contacts a cam on a cam shaft which is used to translate rotational motion of the cam shaft into axial motion of the valve. The valve is closed by a valve spring which biases the valve in a closed position.

The valve train includes a hydraulic lash adjuster which compensates for a change in valve length due to thermal expansion caused by temperature changes as well as valve seat wear. This type of valve train is a high pressure system which, through hydraulic pressure generated by the lubrication system, keeps the valve lifter in proper contact with the cam to perform the valve opening/closing function. The constant hydraulic pressure continuously applied to the valve to maintain proper contact with the cam, in addition to the forces induced by the cam, results in increased friction losses and significant wear to the components of the valve train.

However, the hydraulic pressure is expected to provide hydrodynamic film lubrication between a journal of the cam and bearing surfaces of the cam shaft, and the tappet surface and the cam surfaces. Because of the high unit loads, the valve train operates in a predominantly boundary-to-mixed lubrication regime of a Stribeck diagram, particularly in the 750–2000 engine speed range. This speed range represents more than 80% of the driving cycle for passenger vehicle operation. Because the operation is in the predominantly boundary-to-mixed lubrication regime, the contacting components are subject to significant wear, as much as 30 to 150 microns on the cam during the life of the engine.

Additionally, engine speed is limited by the incidence of "valve toss" which is due to the reciprocating mass of the valve train. Reducing the valve train mass decreases the forces due to inertia and, as a result, permits higher engine operating speeds which, in turn, result in greater engine output. Further, reducing the friction between the moving components significantly reduces the wear and eliminates the need for a heavy, complex and expensive hydraulic system and enables the engine to operate at normal hydraulic pressures without the friction losses and corresponding wear encountered in standard hydraulic systems. The reduction in friction, in turn, results in fuel economy improvement and the reduction in wear improves component durability and, as a consequence, engine life. Thus, there is a need in the art to reduce the mass of the valve train and friction between moving components of the valve train. There is also a need in the art to use relatively low cost and easily formed components of the valve train.

SUMMARY OF THE INVENTION

Accordingly, the present invention is a unique lightweight and low friction valve train for an engine such as an internal combustion engine. In general, the valve train includes a cam shaft having at least one cam, the outer surfaces thereof treated such that the treated surface has an open porosity. A solid film lubricant is impregnated on the treated surfaces. The valve train further includes a lightweight tappet having a peripheral surface treated such that the treated surface has an open porosity. The treated surface is impregnated with a solid film lubricant. The tappet includes an insert which contacts the cam. The insert of the tappet includes a wear resistant contact surface. In addition, a valve guide may have an inner surface treated to create an open porosity and impregnated with a solid film lubricant to reduce the friction at the valve/valve guide interface. The solid film lubricant has an affinity for oil and promotes rapid formation of a stable oil film to reduce friction between the components.

Additionally, the present invention is a low friction cam shaft for actuating at least one valve of an internal combustion engine. The cam shaft includes a shaft member extending longitudinally and at least one cam secured to the shaft member. The cam is made of a plurality of density metal materials and has an outer surface impregnated with a solid film lubricant that has an affinity for oil and promotes rapid formation of a stable oil film to reduce friction therebetween.

One advantage of the present invention is that a low friction valve train is provided for an internal combustion engine Another advantage of the present invention is that a solid film lubricant is applied to the contacting surfaces of the valve train, thereby reducing contact pressures which correspondingly reduces friction and wear. Yet another advantage of the present invention is that the valve train incorporates a solid film lubricant to avoid the frictional losses occurring as a result of hydraulic loading of the tappet against the cam. A further advantage of the present invention is that the solid film lubricant applied to components of the valve train results in the frictional losses and corresponding wear being significantly reduced, thereby obviating the need for a heavy, complex and expensive hydraulic system. A still further advantage of the present invention is that a lightweight and low friction cam shaft is provided by using dual/multiple density powder metal lobes interspersed with a solid film lubricant and attached to a hollow shaft. Yet a further advantage of the present invention is that the composite powder metal cam shaft is easily formed, result ng in a relatively low cost. Additionally, such a low friction valve train will reduce or eliminate wear during oil starved conditions such as cold start and, thus, increase component life and engine life significantly.

Other objects, features and advantages of the present invention will be readily appreciated as the same becomes better understood after reading the following description in conjunction with the accompanying drawings.

BRIEF DESCRIPTION OF THE DRAWINGS

FIG. 1 is a partial fragmentary view of a valve train, according to the present invention, illustrated in operational relationship to an engine.

FIG. 2 is an enlarged view of a tappet assembly for the valve train of FIG. 1.

FIG. 7 is an enlarged view of a valve and valve guide for the valve train of FIG. 1.

FIG. 8 is an enlarged view of a valve and valve seat for the valve train of FIG. 1.

FIG. 9 is an enlarged view of a portion of the valve train of FIG. 1 prior to break-in.

FIG. 10 is a view similar to FIG. 9 after break-in.

DESCRIPTION OF THE PREFERRED EMBODIMENT(S)

Figure 3:
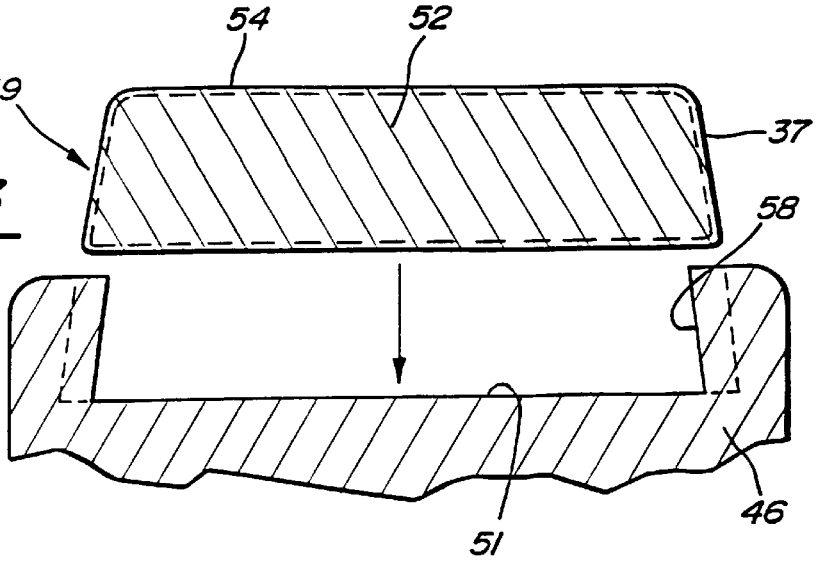
FIG. 3 is an exploded view of a portion of the tappet assembly of FIG. 2.
Figure 4:
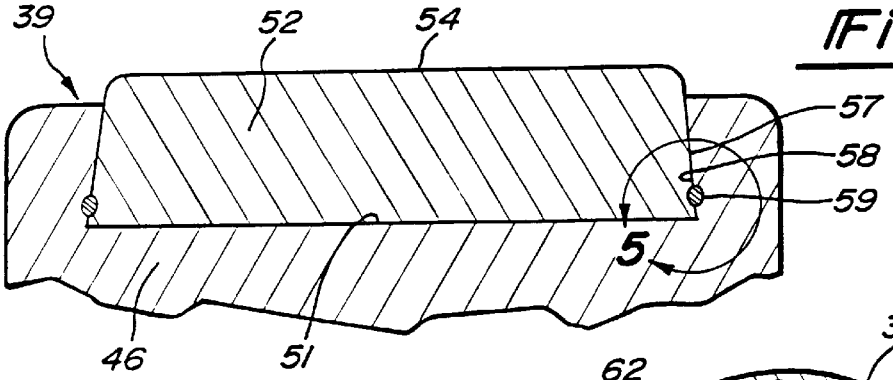
FIG. 4 is an enlarged view of the portion of the tappet assembly of FIG. 3 as assembled.
Figure 5:
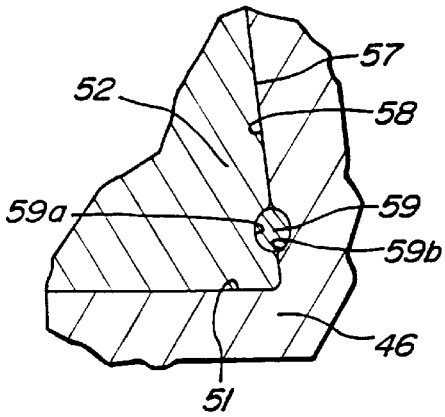
FIG. 5 is an enlarged view of a portion of the tappet assembly in circle 5 of FIG. 4.

Referring to the drawings and in particular FIG. 1 thereof, a valve train 12, accordingly to the present invention, is illustrated in operational relationship to an engine, generally indicated at 14, such as an internal combustion engine. The engine 14 includes a cylinder or engine block 15 having at least one, preferably a plurality of hollow cylinders 16 therein. The engine 14 also includes a cylinder or engine head 18 secured to the cylinder block 15 by suitable means such as fasteners (not shown). The cylinder head 18 has an intake passageway 20 and an exhaust passageway 22 communicating with the cylinders 16.

The valve train 12 includes at least one, preferably a plurality of valve assemblies, generally indicated at 24 for opening and closing the intake passageway 20 and exhaust passageway 22. Preferably, separate valve assemblies 24 are used for the intake passageway 20 and the exhaust passageway 22. The valve train 12 also includes at least one, preferably a plurality of cam shafts 26 for opening and closing the valve assemblies 24. The cam shaft 26 includes a shaft member 27 rotatably supported within the cylinder head 18 as is known in the art. The cam shaft 26 has at least one, preferably a plurality of cams 28 which contact and move the valve assemblies 24. The cams 28 have a base circle portion 30 and a lobe portion 32.

Each valve assembly 24 includes a valve 34 having a head portion 35 and a stem portion 36 slidably disposed in a valve guide 37. The valve guide 37 is disposed in an aperture 38 of the cylinder head 18 as is known in the art. The valve assembly 24 also includes a tappet assembly 39 contacting one end of the stem portion 35 of the valve 34 and engaging a cam 28 of the cam shaft 26. The tappet assembly 39 is slidably disposed in a tappet guide aperture 40 of the cylinder head 18 as is known in the art. The valve assembly 24 further includes a valve spring 41 disposed about the stem portion 35 of the valve 34 and having one end contacting the cylinder head 18 and the outer end contacting a valve spring retainer 42 disposed about the stem portion 35. The valve spring 41 urges the head portion of the valve 34 into engagement with a valve seat 43 to close a corresponding intake or exhaust passageway 20, 22. The valve seat 43 is disposed in a recess 44 of the cylinder head 18 at the end of the intake or exhaust passageway 20, 22 adjacent the cylinder 16.

Referring now to FIG. 2, a tappet assembly 39, according to the present invention, is illustrated. The tappet assembly 39 includes a tappet body 46 which is generally cylindrical in shape and having a hollow interior 47 to receive the stem portion 35 of the valve 34. Preferably, the tappet body 46 is made from a metal material such as a die cast strength aluminum or magnesium alloy. The outer periphery or surface of the tappet body 46 is hard anodized. The anodizing process results in a coating which is submicroscopically porous, e.g., a pore size of approximately 3–10 microns, for allowing a solid film lubricant 50 to be impregnated within the tappet body 46 prior to finish grinding. It is important that the depth of the anodized layer be adequate, approximately 30–40 microns, to support the bearing loads. Also, the anodizing process should produce a suitable anodized layer of sufficient depth and integrity that it does not crumble under fatigue loading. The solid film lubricant 50 must be impregnated to a depth of at least a few microns greater than the expected wear, e.g., if expected wear is around 30 microns then a solid film lubricant impregnation to approximately 35–40 microns is satisfactory.

The solid film lubricant 50, as used herein, is a solid lubricant that has a coefficient of friction of 0.02–0.1 at 600° F. The solid film lubricant 50 is preferably a composite, by volume, of 40% graphite, 20% $MoS_2$ and the remainder a thermally stable (does not decompose up to 375° C. or 700° F.) polymer such as polyarylsulfone or a high temperature epoxy such as bisphenol A and vinyl butoryl combined with dicyandianide. The solid film lubricant 50 of the type described here promotes rapid stable oil film formation due to its affinity for conventional lubricating oils. The solid film lubricant 50 may also be a metal matrix composite having about 40% graphite and the remainder aluminum or cast iron. Such metal matrix composites may be formed by powder metallurgy or other suitable means to provide a porus material that can expose graphite for intermittent or supplementary lubrication purposes. Up to 13% of the graphite may be substituted with boron nitride. The solid lubricant may also include up to 10% copper and one of LiF, NaF, and CaF as a substitute for the $MoS_2$. It should be appreciated that other compositions suitable as solid film lubricants may also be used.

As illustrated in FIGS. 2 through 5, the tappet assembly 39 also includes a cavity 51 at an upper end thereof. The cavity 51 is generally cylindrical in shape. The tappet assembly 39 also includes a wear resistant insert 52 having a contacting surface 54 which contacts a cam 28 or a cam shaft 26. Preferably, the insert 52 is made of ceramic material but may also be manufactured from a high strength steel, toughened alumina or silicon nitride sintered. The insert 52 is machined to fit in the cavity 51 of the tappet body 46. The insert 52 and cavity 51 are matched for a smooth fit. Preferably, the sides of the insert 52 and the cavity 51 include complementary inverse tapers 57 and 58, respectively, to lock the insert 52 within the cavity 51. The insert 52 is secured within the cavity 51 through a shrink-f it process. The shrink-fit process includes heating the tappet body 46 to a temperature approximately 100° F. higher than the engine operating temperature (approximately 310° F.), and cooling the insert 52 to a temperature below a low end ambient temperature (approximately −50° F.) after which the insert 52 is placed in the cavity 51. When the tappet assembly 39 is brought to room temperature, the tappet body 46 shrinks around the insert 52 because of the significantly higher thermal expansion of the tappet body 46 relative to that of the insert 52. This process insures that the insert 52 remains in compression during the entire operating range of engine temperatures. It should be appreciated that the insert 52 may also be secured to the tappet body 46 through the use of a lock ring 59 engaging corresponding annular grooves 59*a* and 59*b* formed in both the insert 52 and the tappet body 46, respectively.

Figure 6:
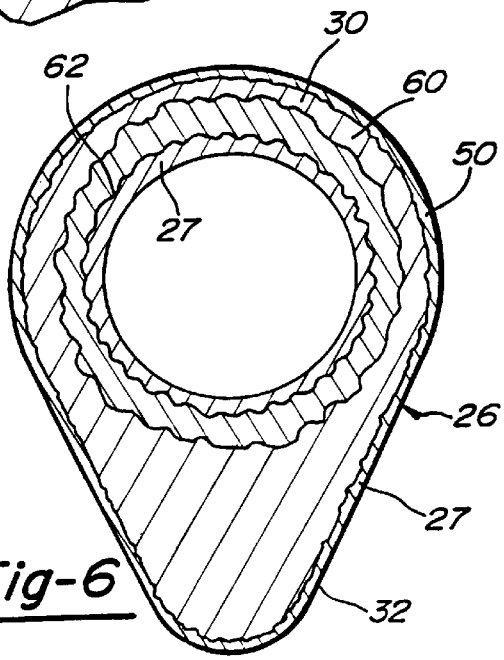
FIG. 6 is an enlarged view of a cam for the valve train of FIG. 1.

Referring to FIG. 6, a cam 28 of the cam shaft 26 is shown. The base circle portion 30 of the cam 28 includes an interior portion 60 made from a metal material of a soft/low carbon steel to minimize stresses occurring during rotation of the cam shaft 26. The interior portion 60 is mechanically secured to a fluted or roughened portion 62 of the shaft 27. The lobe portion 32 and the remaining portion of the base circle portion 30 of the cam 28 are made from a metal material such as a porous medium/high carbon Ni—Cr alloy steel. The outer periphery or surfaces of the base circle portion 30 and lobe portion 32 are hardened to a normally specified hardness level for a cam surface (usually around Rc 55) utilizing any one of the well known processes, e.g. carbo nitrating. Generally, the porosity extends only to a depth of less than 1.0 mm. The porosity enables the outer surfaces of the cam 28 to be impregnated with the solid film lubricant 50. The depth of the solid film lubricant 50 impregnation should be at least a few microns greater than the expected wear as previously described.

Referring to FIG. 7, the valve guide 37 is shown. The valve guide 37 has an inner surface 66 impregnated with the solid film lubricant 50 to reduce the friction between the stem portion 35 of the valve 34 and the valve guide 37. Preferably, the inner surface 66 of the valve guide 37 includes a wear resistant porous layer formed by a suitable means to facilitate impregnation of the solid film lubricant 50 as previously described.

Referring to FIG. 8, the valve seat 43 is shown. The valve seat 43 has an outer surface 68 also impregnated with the solid film lubricant 50 to reduce the friction and corresponding wear occurring between the head portion 35 and valve seat 43. Alternatively, the outer surface of the head portion 35 of the valve 34 may be impregnated with the solid film lubricant 50 and the head portion 35 may be hollow with a wear resistant insert at the lower end thereof. It should be appreciated that the valve seat 43 is treated to form a wear resistant porous layer as previously described.

Referring to FIG. 9, a portion of the solid film lubricant 50 on a corresponding valve train component such as the tappet body 46 prior to break in is illustrated. The solid film lubricant 50 is impregnated to an effective wear depth and includes a superficial layer. After engine break in, the layer of solid film lubricant 50 forms a stable low friction wear resistant film as illustrated in FIG. 10.

In operation, the solid film lubricant 50 promotes the formation of a stable lubrication film. The stable lubrication film reduces friction occurring at higher operating speeds where hydrodynamic lubrication is predominate. Rapid formation of a lubrication film significantly reduces cam wear by reducing the friction at lower engine speeds.

Figure 11:
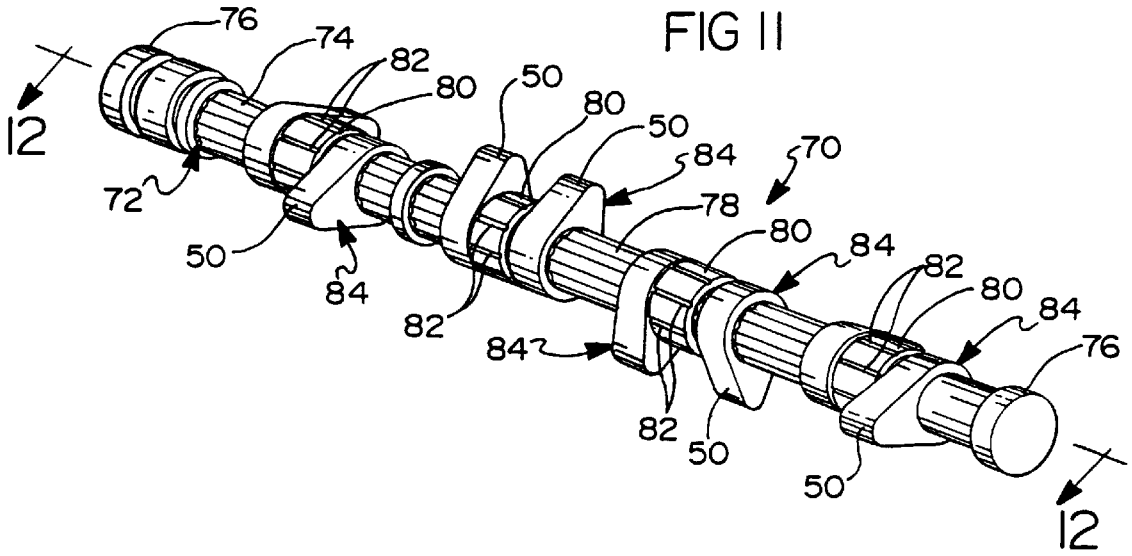
FIG. 11 is a perspective view of a low friction cam shaft, according to the present invention, for the valve train of FIG. 1.
Figure 12:
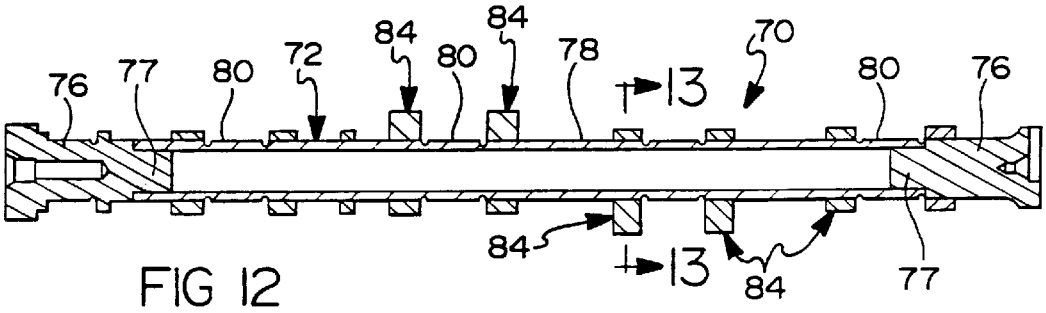
FIG. 12 is a sectional view taken along line 12—12 of FIG. 11.
Figure 13:
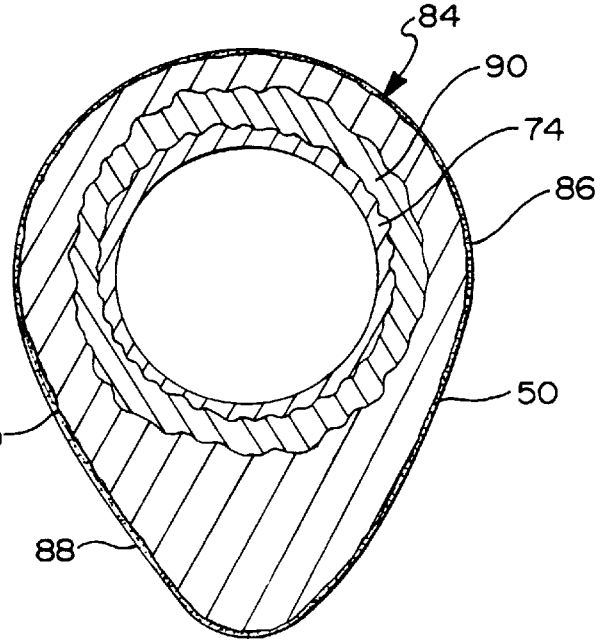
FIG. 13 is a sectional view taken along line 13—13 of FIG. 12.

Referring to FIGS. 11 through 13, a low friction cam shaft 70, according to the present invention, is shown for the valve train 12. The cam shaft 70 may be used in place of the cam shaft 26 for opening and closing the valve assemblies 24. The cam shaft 70 includes a shaft member, generally indicated at rotatably supported within the cylinder head as is known in the art. The shaft member 72 has a shaft 74 extending longitudinally and is an extruded hollow or tubular member. The shaft member 72 also has ends 76 which are solid and have a portion 77 disposed within the ends of the shaft 74. Preferably, the shaft member 72 has an outer periphery or surface 78 which is roughened, fluted or knurled for a function to be described.

Preferably, the shaft member 72 is made from a metal material such as a die cast strength aluminum or magnesium alloy. The outer surface 78 is hard anodized. The anodizing process results in a coating which is submicroscopically porous, e.g., a pore size of approximately 3–10 microns, for allowing the solid film lubricant 50 to be impregnated prior to finish grinding. It is important that the depth of the anodized layer be adequate, approximately 30–40 microns, to support the bearing loads. Also, the anodizing process should produce a suitable anodized layer of sufficient depth and integrity that it does not crumble under fatigue loading. The solid film lubricant 50 must be impregnated to a depth of at least a few microns greater than the expected wear, e.g., if expected wear is around 30 microns, then the solid film lubricant 50 should be impregnated to approximately 35–40 microns.

The cam shaft 70 also includes at least one, preferably a plurality of bearing members 80 disposed about the shaft member 72 at predetermined positions longitudinally therealong. The bearing members 80 may have an outer diameter greater than an outer diameter of the shaft 74. The bearing members 80 are integral with the shaft member 72 and are formed by grinding the outer surface 78 to a predetermined dimension. The bearing members 80 may have at least one, preferably a plurality of grooves or furrows 82 extending transversely and spaced circumferentially thereabout. It should be appreciated that the bearing members 80 have the solid e film lubricant 50 embedded in the outer bearing surface thereof.

The cam shaft 70 further includes at least one, preferably a plurality of cams, generally indicated at 84, which contact and move the valve assemblies 24. The cams 84 are formed by powder metallurgy from, at least two, preferably a plurality of density metal powders to form a composite metal interspersed with the solid film lubricant 50. The cams 84 have a base circle portion 86 and a lobe portion 88. The base circle portion 86 includes an interior portion 90 made from a first density powder metal material such as a soft/low carbon steel to minimize stresses occurring during rotation of the cam shaft 70. The interior portion 90 is mechanically secured to the outer surface 78 of the shaft member 72, for example, by internal mechanical twist or pressurizing hydraulic fluid as is known in the art. The lobe portion 88 and the remaining portion of the base circle portion 86 are made from a second density powder metal material such as porous metallic high carbon (approx. 0.5 C) Ni—Cr alloy steel.

The outer periphery or surfaces of the base circle portion 86 and lobe portion 38 are hardened to a normally specified hardness level for a cam surface (usually around Rc 55) utilizing any one of the well known processes, e.g. carbo nitrating. Generally, the porosity extends only to a depth of less than 1.0 mm. The porosity enables the outer surfaces of the cam 84 to be impregnated with the solid film lubricant 50. The depth of the solid film lubricant 50 impregnation is at least a few microns greater than the expected wear as previously described. For example, in the case of the cam 84, the expected wear is around 30 microns and therefore the impregnation of the solid film lubricant 50 is approximately 35 to 40 microns in depth. It should be appreciated that "density" refers to porousity and that the second density powder metal material is five to ten percent porous whereas the first density powder metal material is less than one percent porous.

Alternatively, the outer surfaces of the base circle portion 86 and lobe portion 88 can be made porous by the addition of an arc plasma spray coating. The coating can be any suitable hard material such as Silicon (Si) or Tungsten Carbide dispersed in Nickel (Ni) and the porousity generated by controlling particle size. The coating may be an iron base material such as FeCrNi or commercial available Triboloy ($Ni_{18}Cr_{16}Al_4$ alloy). The coating is of a sufficient thickness such as one hundred fifty (150) microns. It should be appreciated that the porous coating is impregnated with the solid film lubricant 50. It should also be appreciated that the coating is applied by conventional arc plasma spray processes as is known in the art.

Accordingly, the solid film lubricant 50 on the valve train 10 reduces friction losses, the contact forces due to the elimination of hydraulic loading, and reduces inertia forces due to a significant reduction in the reciprocating mass. As a result, the valve train 10 permits significantly higher engine operating speeds and a reduction in friction and wear which extends corresponding engine life. Because of the significantly reduced wear, the valve train 10 does not require adjustment for life of the engine nor does it require a hydraulic lash adjustment and the attendant precision machining and hydraulic lubrication requirements. Also, the low friction cam shaft 70 provides a reduction in friction for the valve train 12 while using relatively low cost, easily formed composite powder metal cams 84 interspersed with solid film lubricant 50.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A low friction cam shaft for actuating at least one valve of an internal combustion engine comprising:

a shaft member extending longitudinally and having a first outer surface;

at least one cam secured to said shaft member; and said at least one cam being made of a plurality of density metal materials, said at least one cam having a base circle portion and a lobe portion, said base circle portion having an interior portion and an outer portion, said outer portion of said base circle portion and said lobe portion being made of one of said density metal materials, said interior portion being made of another of said density metal materials, said interior portion having a porosity less than said lobe portion and said outer portion of said base circle portion, said outer portion of said base circle portion and said lobe portion having a second outer surface, said first and second outer surfaces having an open porosity and are impregnated with a solid film lubricant that has an affinity for oil and promotes rapid formation of a stable oil film to reduce friction therebetween.

2. A low friction cam shaft as set forth in claim 1 wherein one of said density metal materials is a porous medium to high carbon Ni—Cr alloy steel, said solid film lubricant being impregnated within the open porosity.

3. A low friction cam shaft as set forth in claim 2 wherein one of said density metal materials is a soft and low carbon steel.

4. A low friction cam shaft as set forth in claim 1 wherein said interior portion is made of a soft and low carbon steel.

5. A low friction cam shaft as set forth in claim 4 therein said lobe portion and said outer portion of said base circle portion are made of a porous medium to high carbon Ni—Cr alloy steel.

6. A low friction cam shaft as set forth in claim 1 wherein said shaft member has a hollow shaft with said first outer surface that is either one of roughened and fluted and knurled.

7. A low friction cam shaft as set forth in claim 6 wherein said shaft member has solid ends with a portion disposed within said shaft.

8. A low friction cam shaft as set forth in claim 1 including at least one bearing member on said shaft member.

9. A low friction cam shaft as set forth in claim 8 wherein said bearing member has at least one furrow extending along the longitudinal direction of said shaft member.

10. A low friction cam shaft as set forth in claim 1 wherein said solid film lubricant is comprised of graphite, boron nitride, molybdenum disulfide in a high temperature polymer base.

11. A low friction cam shaft for actuating at least one valve of an internal combustion engine comprising:

a shaft member extending longitudinally and having ia first outer surface;

at least one cam secured to said shaft member having a base circle portion and lobe portion, said base circle and lobe portions having a second outer surface, said first and second outer surfaces having an open porosity and are impregnated with a solid film lubricant comprised of graphite and at least one of molybdenum disulfide and boron nitride in either one of a high temperature polymer and epoxy base, the solid film lubricant has an affinity for oil and promotes rapid formation of a stable oil film to reduce friction therebetween.

12. A low friction cam shaft as set forth in claim 11 wherein said at least one cam is made of a plurality of density powder metal materials.

13. A low friction cam shaft as set forth in claim 11 wherein an interior portion of said base circle portion is formed of a soft and low carbon steel.

14. A low friction cam shaft as set forth in claim 11 wherein said lobe portion and a remainder of said base circle portion are formed of a porous medium to high carbon Ni—Cr alloy steel.

15. A low friction cam shaft as set forth in claim 11, including at least one bearing member on said shaft member.

16. A low friction cam shaft as set forth in claim 15 wherein said at least one bearing member includes at least one furrow extending along the longitudinal direction of said shaft member.

17. A low friction cam shaft for actuating at least one valve of an internal combustion engine comprising:

a shaft member extending longitudinally and having a first outer surface;

at least one cam secured to said shaft member having a base circle portion and lobe portion, said base circle and lobe portions having a second outer surface, wherein an interior portion of said base circle portion is a soft low carbon steel;

wherein said lobe portion and a remainder of said base circle portion are formed of a porous medium to high carbon Ni-Cr alloy steel; and at least one bearing member on said shaft member having a third outer surface with at least one furrow extending along the longitudinal direction of said shaft. member;

said first and second and third outer surfaces having an open porosity and are impregnated with a solid film lubricant, the solid film lubricant has an affinity for oil and promotes rapid formation of a stable oil film to reduce friction therebetween.

18. A low friction cam shaft for actuating at least one valve of an internal combustion engine comprising:

a shaft member extending longitudinally and having a first outer surface;

at least one cam secured to said shaft member having a base circle portion and lobe portion, said base circle and lobe portions having a second outer surface, said first and second outer surfaces having an open porosity and are impregnated with a solid film lubricant that has an affinity for oil and promotes rapid formation of a stable oil film to reduce friction therebetween.

19. A low friction cam shaft for actuating at least one valve of an internal combustion engine comprising:

a shaft member extending longitudinally and having a first outer surface;

at least one cam secured to said shaft member having a base circle portion and lobe portion, said base circle and lobe portions having a second outer surface, at least one bearing member on said shaft member having a third outer surface;

said first and second and third outer surfaces having an open porosity and are impregnated with a solid film lubricant, the solid film lubricant has an affinity for oil and promotes rapid formation of a stable oil film to reduce friction therebetween.

* * * * *